US007526828B2

(12) United States Patent
Kniese

(10) Patent No.: US 7,526,828 B2
(45) Date of Patent: May 5, 2009

(54) TOOTHBRUSH

(75) Inventor: Leif Kniese, Berlin (DE)

(73) Assignee: GlaxoSmithKline Consumer Healthcare GmbH & Co KG, Buehl (Baden) (DE)

( * ) Notice: Subject to any disclaimer, the term of this patent is extended or adjusted under 35 U.S.C. 154(b) by 0 days.

(21) Appl. No.: 11/815,991

(22) PCT Filed: Feb. 21, 2006

(86) PCT No.: PCT/EP2006/001770

§ 371 (c)(1),
(2), (4) Date: Aug. 10, 2007

(87) PCT Pub. No.: WO2006/089784

PCT Pub. Date: Aug. 31, 2006

(65) Prior Publication Data

US 2008/0148507 A1 Jun. 26, 2008

(30) Foreign Application Priority Data

Feb. 22, 2005 (DE) ..... 10 2005 008 199

(51) Int. Cl.
*A46B 9/04* (2006.01)
*A46B 5/00* (2006.01)

(52) U.S. Cl. ..... 15/167.1; 15/172

(58) Field of Classification Search ..... 15/167.1, 15/201, 172

See application file for complete search history.

(56) References Cited

U.S. PATENT DOCUMENTS

| | | | | |
|---|---|---|---|---|
| 1,327,807 A | | 1/1920 | Burleigh | |
| 2,273,207 A | * | 2/1942 | Kuhn | 15/167.1 |
| 2,706,825 A | | 4/1955 | Blakeman | |

FOREIGN PATENT DOCUMENTS

| | | |
|---|---|---|
| DE | 10154969 | 6/2003 |
| GB | 2297478 | 8/1996 |
| WO | WO97/07707 | 3/1997 |
| WO | WO00/30494 | 6/2000 |
| WO | WO03/039816 | 5/2003 |

* cited by examiner

*Primary Examiner*—Randall Chin
(74) *Attorney, Agent, or Firm*—Nora Stein-Fernandez; Theodore R. Furman

(57) ABSTRACT

A toothbrush with a cleaning zone on which tooth-cleaning elements are arranged, which are pressed against the teeth during cleaning with a cleaning force, and with a deformable element by which the cleaning zone is can be adapted to the shape of the tooth surface by the cleaning force, where the deformable element has at least a first flexible wing facing towards the cleaning zone and a second such wing facing away from the cleaning zone, and also at least one guide element, and where the first and second wings are held together moveably by the guide element. In order to provide an improved toothbrush which cleans the teeth more effectively and at the same time more gently, it is provided according to the invention that the wings form a wedge, by being connected together at one end and distanced from each other at the other end.

20 Claims, 6 Drawing Sheets

TOOTHBRUSH

BACKGROUND OF THE INVENTION

This invention relates to toothbrushes. Toothbrushes are well known devices generally comprising a handle by which the toothbrush is held, and a cleaning zone (commonly known as a "head") on which tooth-cleaning elements are arranged, and which are pressed with a cleaning force against the teeth during cleaning. The head and handle define a toothbrush longitudinal handle-head direction, with a neck longitudinally between the head and handle. Tooth cleaning elements normally project from the cleaning zone in a direction transverse to the longitudinal direction, termed herein the "bristle direction", because bristles are the most common type of cleaning element.

In particular this invention relates to a toothbrush with a cleaning zone on which tooth-cleaning elements are arranged, and with a deformable element by which the cleaning zone can be adapted to the shape of the tooth surface by the cleaning force, where the deformable element has at least a first flexible wing facing towards the cleaning zone and a second such wing facing away from the cleaning zone, and also at least one guide element, and where the first and second wings are held together moveably by the guide element.

Such a toothbrush is known for example from DE-A-101 54 969, where the toothbrush handle can be turned into an S shape of varying degree by the user's finger pressure. The toothbrush according to DE-A-101 54 969 makes it easier to clean the difficult-to-reach premolars.

The drawback of the toothbrush according to DE-A-101 54 969 and of other known toothbrushes is that complete removal of plaque from the teeth can generally not be guaranteed, even by regular brushing. For complete removal of plaque it is necessary, in addition to brushing, to use dental floss to clean the interdental spaces, for example.

The present invention is therefore based on the task of providing an improved toothbrush which cleans the teeth more effectively and at the same time more gently than known toothbrushes.

SUMMARY OF THE INVENTION

According to this invention there is provided a toothbrush with at least one cleaning zone on which tooth-cleaning elements are arranged, which are pressed against the teeth during use with a cleaning force, and with at least one deformable element by which the cleaning zone can be adapted to the shape of the tooth surface by the cleaning force, where the deformable element has at least a first flexible wing arranged relatively towards the cleaning zone and a second such wing arranged relatively away from the cleaning zone, and also at least one guide element, and where the first and second wings are held together moveably by the guide element, characterised in that the wings form a wedge, being connected together at one end and distanced from each other at the other end.

The task is solved by the toothbrush according to the invention in that the wings form a wedge in which they are joined together at one end and are at a distance from each other at the other end. Preferably the wings form a wedge in which they are joined together at a point relatively further from the handle, and are at a distance from each other at a point relatively closer to the handle. In such a construction the wedge-shape tapers in the longitudinal direction from the handle, narrowing toward the cleaning zone.

In this surprisingly simple solution the cleaning zone of the toothbrush according to the invention astonishingly moulds itself to the surfaces of the teeth during brushing, so that the tooth-cleaning elements also penetrate into the interdental spaces and can remove the plaque located there more effectively.

As a result of the cleaning force during brushing, which is exerted as a counterforce by the tooth on the wing, the wing and thus also the cleaning zone may be caused to curve concavely around an individual tooth, plural teeth or the dental arch. Thus in the solution according to the invention an optimally adapted cleaning zone with individually arranged cleaning elements is created for each section of the user's teeth. As a result of the solution according to the invention the cleaning zone adapts to the shape of an opposite surface, which when brushing the teeth is the teeth to be cleaned.

As the cleaning force applied by the user adapts the cleaning zone to the surfaces of the teeth, during brushing pressure is not necessarily exerted on specific points of the surface of the teeth but over the whole cleaning zone. This means that the teeth may be cleaned particularly gently.

Compared with the known toothbrushes which have a spring element in the handle area and thus a change in the angle of the handle during brushing, the solution according to the invention has the advantage that the unbent toothbrush according to the invention is easier to control during brushing.

DETAILED DESCRIPTION OF THE INVENTION

The toothbrush of the invention can be developed further by various features. A brief description of these features and the advantages associated with the designs is given below.

The said wings comprise longitudinally elongate members which are flexible at least in a plane which includes the bristle direction. Thus the wings can be provided as a tension wing located relatively towards the cleaning zone and a compression located relatively away from the cleaning zone. The toothbrush can be provided so that it can be moved from a resting position into a cleaning position by means of the cleaning force exerted on the cleaning zone, whereby in the cleaning position the cleaning zone bends towards the cleaning force compared with the resting position. This has the advantage that the cleaning zone adapts to the contour of a tooth and the cleaning elements adapt with the cleaning zone individually for each tooth.

In order to provide the toothbrush according to the invention in a particularly hygienic and easy-to-clean form, the deformable element can be housed inside the toothbrush. Also the wings can define between them a wedge space filled at least partially with an elastic material. Such an elastic material is suitably resiliently compressibly deformable. Additionally or alternatively, such a wedge space can contain a gel or fluid. Thus the deformation of the toothbrush according to the invention caused by the cleaning force can be influenced and different types of toothbrushes can be produced simply by a different filling of the wedge space.

The filled wedge space can be at least partially transparent outwards, e.g. by means of a transparent elastic, gel or fluid material, so that the deformable element is visible from outside, in order to allow visual control of the deformable element. Visual control makes it possible to check the condition of the deformable element. i.e. the guide elements and the tension or compression wing, and any damage can be seen by the user.

In a beneficial development the deformable element can extend at least partially into the cleaning zone, such that the cleaning zone comprises a first flexible wing relatively closer to the tooth cleaning elements and a second such wing relatively further from the cleaning elements, and also at least one guide element, and where the first and second wings are held together moveably by the guide element, characterised in that the wings form a wedge, being connected together at one end and distanced from each other at the other end. This has the advantage that the cleaning force is directed directly into the deformable element during brushing, and thus the deformation of the deformable element is transmitted directly to the cleaning zone.

The deformable element can additionally or alternatively be housed in a handle area of the toothbrush, at a distance from the cleaning zone. Thus the deformable element, connected in its effect with the cleaning zone, can also effect an advantageous deformation of the handle area.

In order to make the deformable element particularly stiffened, the guide element can essentially be designed to be resistant to tension and compression. Alternatively, the guide element can also be provided essentially only resistant to tension as a tension medium, which allows the use of common tension mediums, such as plastic film, cords, cables or chains. This provides a variety of possibilities for the product design of the toothbrush according to the invention.

With the toothbrush according to the invention it can be beneficial, e.g. for technical or aesthetic reasons, to limit the deformation of the cleaning zone. For this purpose at least one elastic spring element working lengthwise can be created in at least one of the wings, which limits the relative deformability of the tension and compression wings in relation to each other. The spring element absorbs the forces working in the tension or compression wing and changes the deformation of the deformable element. Such a spring element can for example be made of an elastic material which is added in a two-stage moulding process during injection moulding of the toothbrush. Also, at least one elastic spring element can be created in the guide element, which changes the deformation of the deformable element above a predetermined cleaning force, which can be varied by the design of the spring element.

In a particularly advantageous further development the guide element can be provided in one piece with the tension and/or compression wing, e.g. integrally formed e.g. of a plastics material. In such an integral construction the guide element may be connected to the wing(s) by relatively thinned hinge parts. This simplifies production and reduces the production costs of the toothbrush according to the invention, because the guide element and the tension and/or compression wing can be produced in one production step, for example by plastic injection moulding. Alternatively, the guide element can also be provided separately from the tension or compression wing, for example in order to make the guide element out of a different material. The guide element can also be connected to the wings in an articulated manner.

In a beneficial embodiment of the toothbrush according to the invention the guide element can comprise a dividing wall and can divide the wedge space into at least two separate sections, one or more of which can be filled with elastic, gel or fluid. This means that the elasticity of the deformable element can be influenced individually for each section, which offers many possibilities for variations of the finished product.

In a further beneficial embodiment the guide element can run linearly and be arranged essentially at right angles to an axis which essentially runs equidistantly between the tension and compression wings. This has the advantage that the thickness of the deformable element, i.e. the distance between the tension and the compression wing, is largest in the resting position and reduces in the deformed state because the guide element is twisted in the cleaning position. This means that the thickness of the toothbrush according to the invention is reduced by the cleaning force, which is particularly beneficial when cleaning the difficult-to-reach premolars. Conversely, the guide element can also be arranged in the deformed cleaning position essentially at right angles to the axis, whereby the thickness of the deformable element is greatest in the deflected state. Alternatively the guide element can be arranged in the resting position or in the cleaning position at any angle diagonal to the axis.

In another advantageous embodiment the guide element can loop the wings together at several connection points located at intervals alternately, e.g. in a meandering pattern, diagonally or in a helix. At the ends such a looped guide element may be connected to the tension or compression wing. Advantageously, changing the length of the looped guide element changes the shape of a pre-curved deformable element. For example, the length of the connecting means can be changed with the help of an adjusting means such as a roller on to which the guide element can be rolled, which means that the shape of the cleaning zone can be adjusted individually.

In order to provide a toothbrush according to the invention with even greater deformation possibilities of the cleaning zone, the toothbrush can have several deformable elements. These can extend from the neck splayed out parallel to each other, in a star shape or in a helix from a pivotal point, for example in a rotatable brush head for an electric toothbrush, and form a joint cleaning zone. Also a deformable element can house a further deformable element.

In a particularly advantageous development of the toothbrush according to the invention the deformable element can have two tension wings running essentially side by side and a compression wing, whereby the guide element connects the compression wing with the two tension wings. In this embodiment the cleaning zone can be arranged on both tension wings and the guide element can be in a V-shape, for example. This embodiment has the advantage that the toothbrush twists if the cleaning force is exerted on only one tension wing. Moreover the deformable element with two tension wings and one compression wing can also have at least two guide elements, each connecting the compression wing with one of the two tension wings. Having a separate guide element for each tension wing means that the cleaning force directed into one tension wing is transmitted less strongly to the second tension wing.

The toothbrush according to the invention can have two deformable elements, the wings of which each span a plane, whereby these two planes run essentially at right angles to each other. This embodiment has the advantage that the toothbrush according to the invention is deformed by different cleaning forces working in different directions.

In order to achieve a different arrangement of the cleaning elements in the cleaning zone, the tension and/or compression wing can be provided convex, concave or undulating to each other. The wings can also be of different lengths and give the deformable element a pre-curved shape.

The cleaning elements in the cleaning zone can also be arranged parallel to each other or crossing. The cleaning elements can also be arranged so that they cross in the cleaning position and thus further improve the cleaning properties of the toothbrush according to the invention.

So that a structure in which the parts protrude or stand back is formed in the cleaning zone during cleaning, cleaning tongues can be created in the cleaning zone which are tangential when the cleaning zone is bent. The cleaning tongues are partially cut away areas of the cleaning zone which do not bend with the rest of the cleaning zone because of the cut-away.

BRIEF DESCRIPTION OF THE DRAWINGS

The invention is elucidated below with reference to the enclosed drawings. The various features can be combined or omitted independently of each other, as has already been stated above in relation to the individual advantageous embodiments.

The drawings show:

Figure 1:
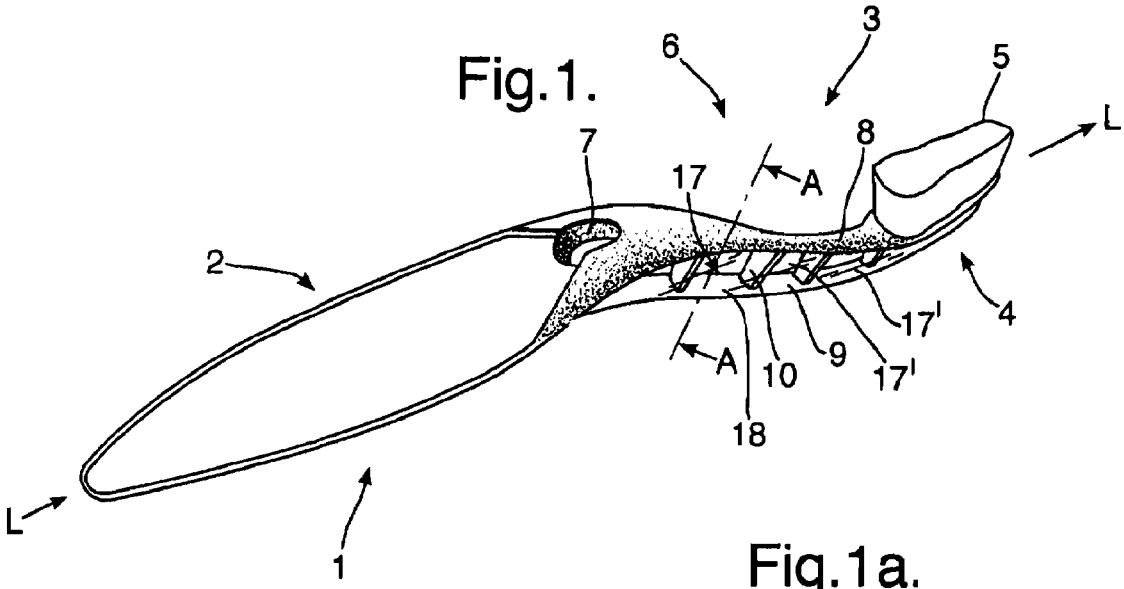
Figure 1A:
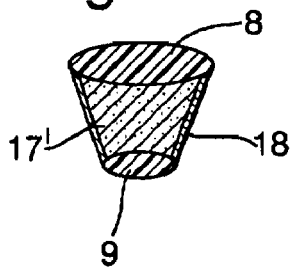
Figure 2:
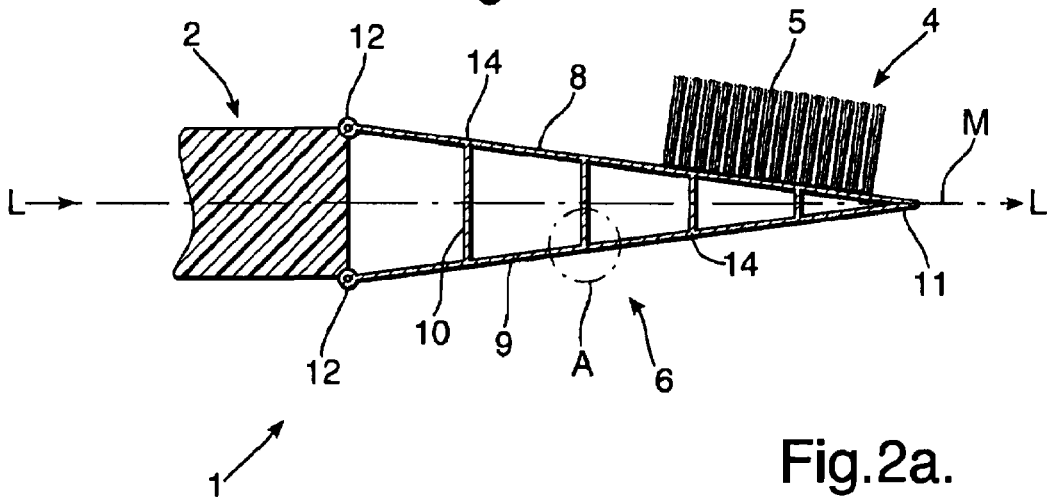
Figure 2A:
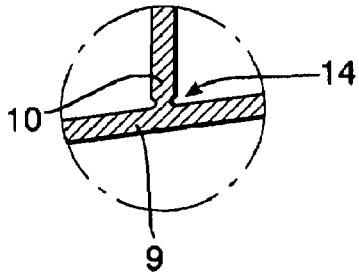
Figure 3:
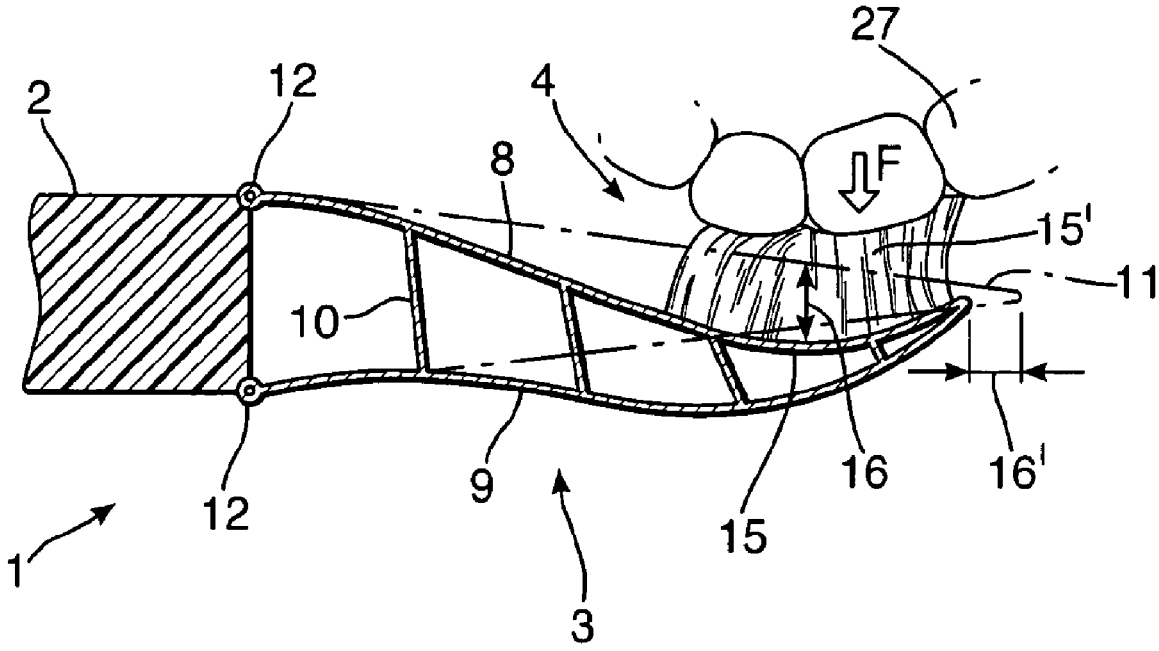
Figure 4:
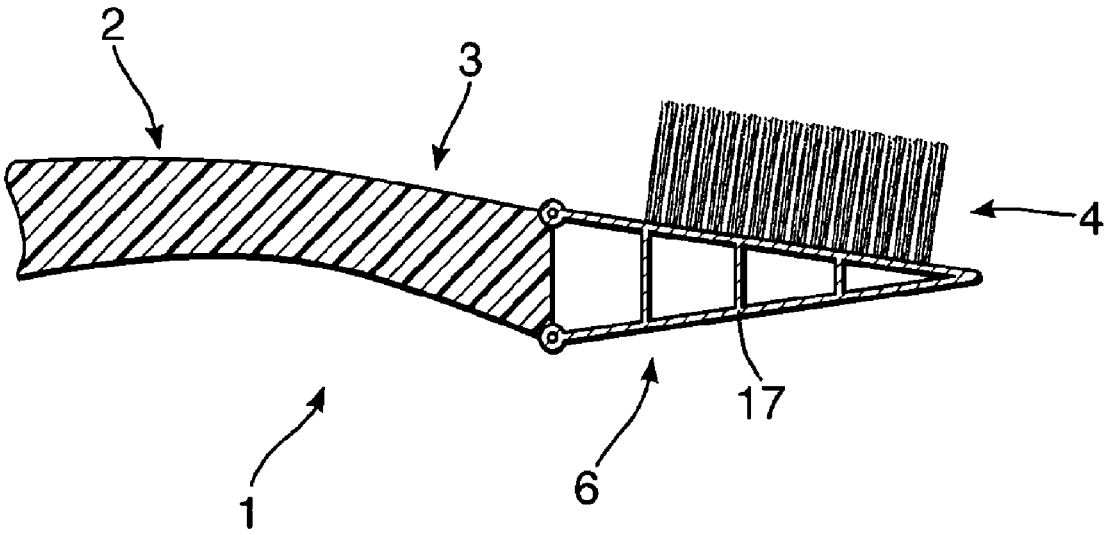
Figure 5:
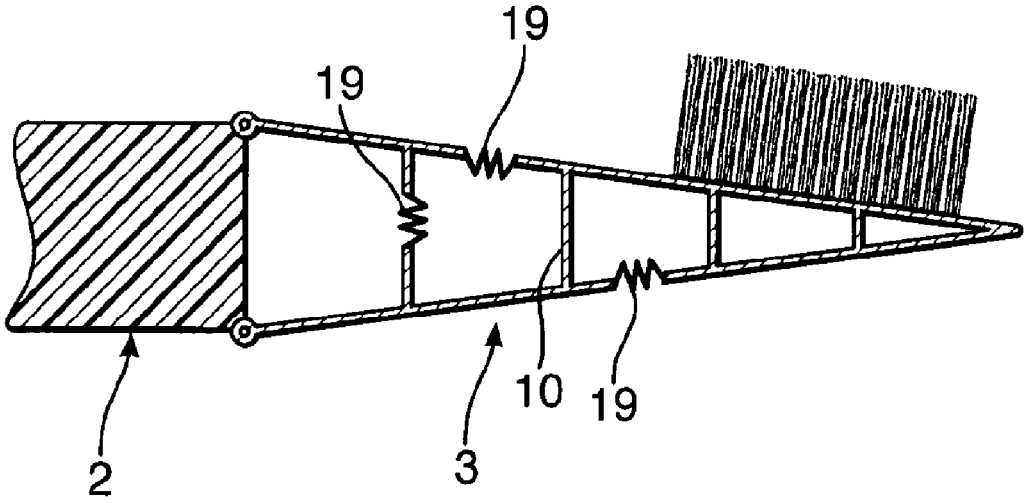
Figure 6:
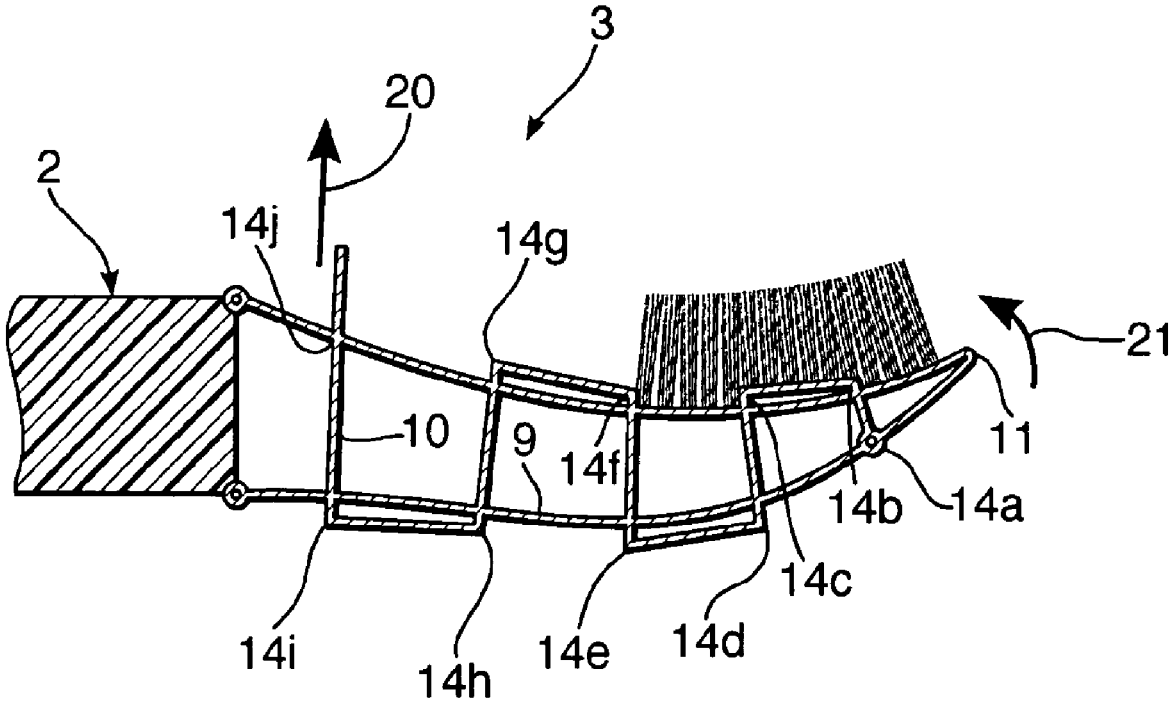
Figure 7:
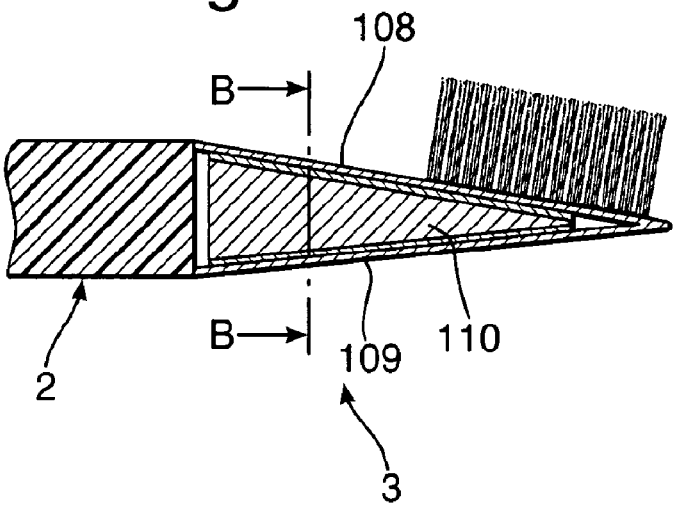
Figure 7A:
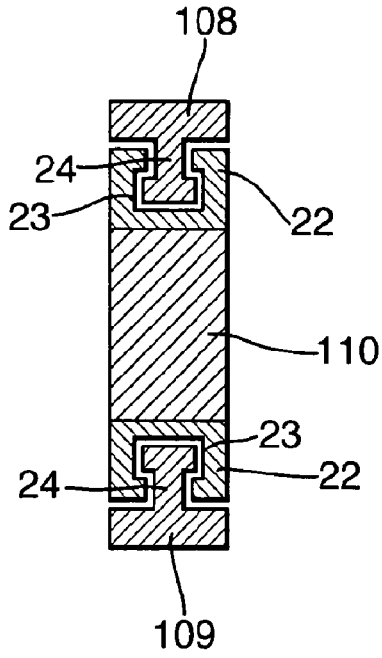
Figure 8:
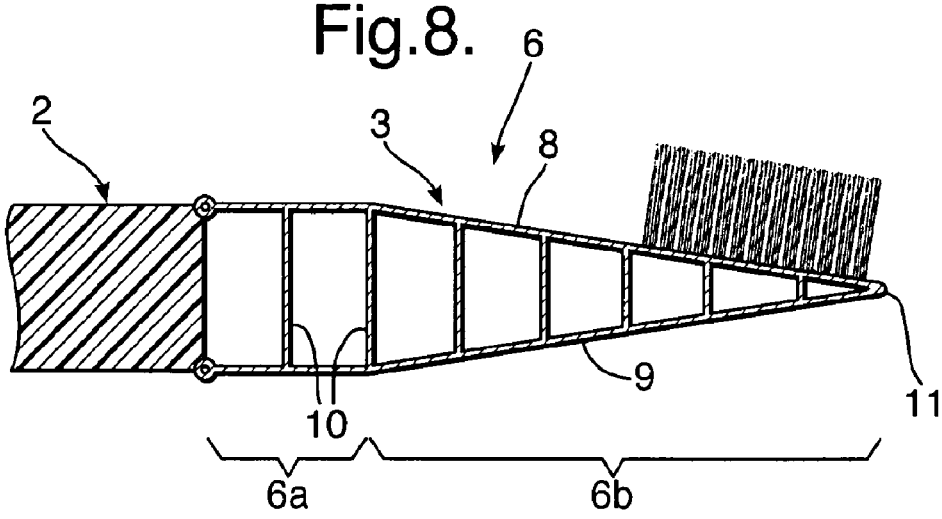
Figure 9:
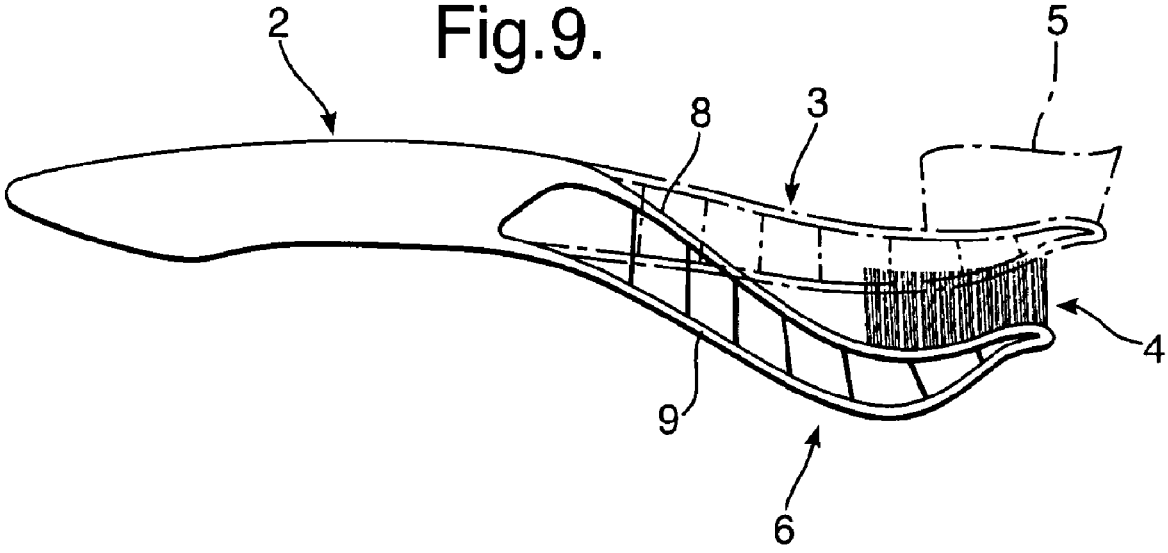
Figure 10:
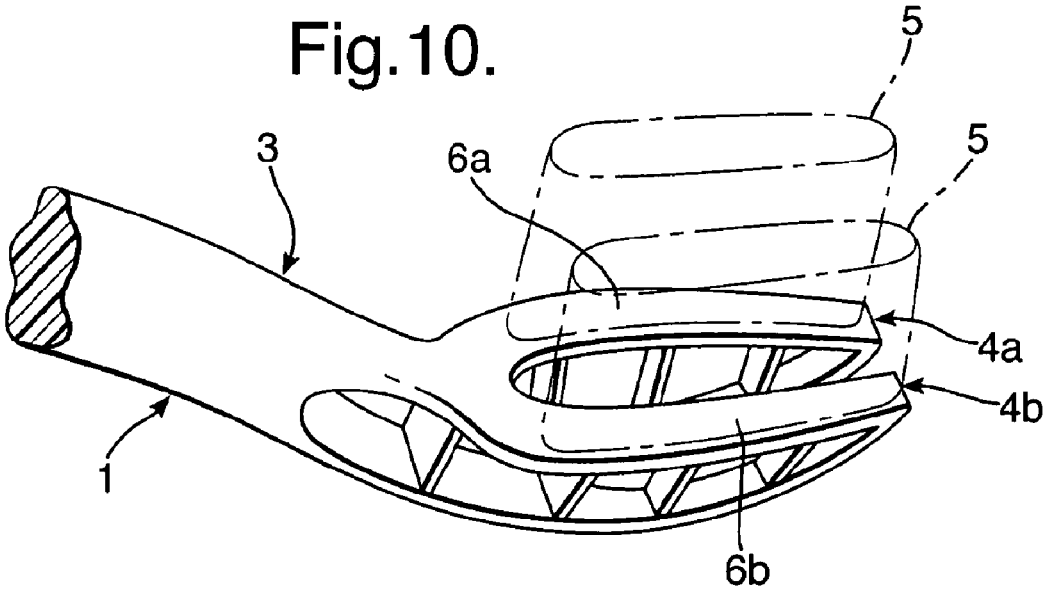
Figure 11:
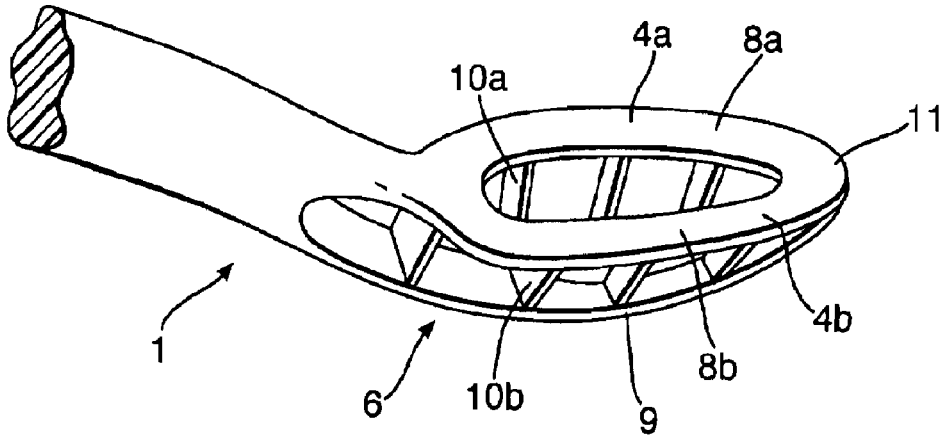
Figure 12:
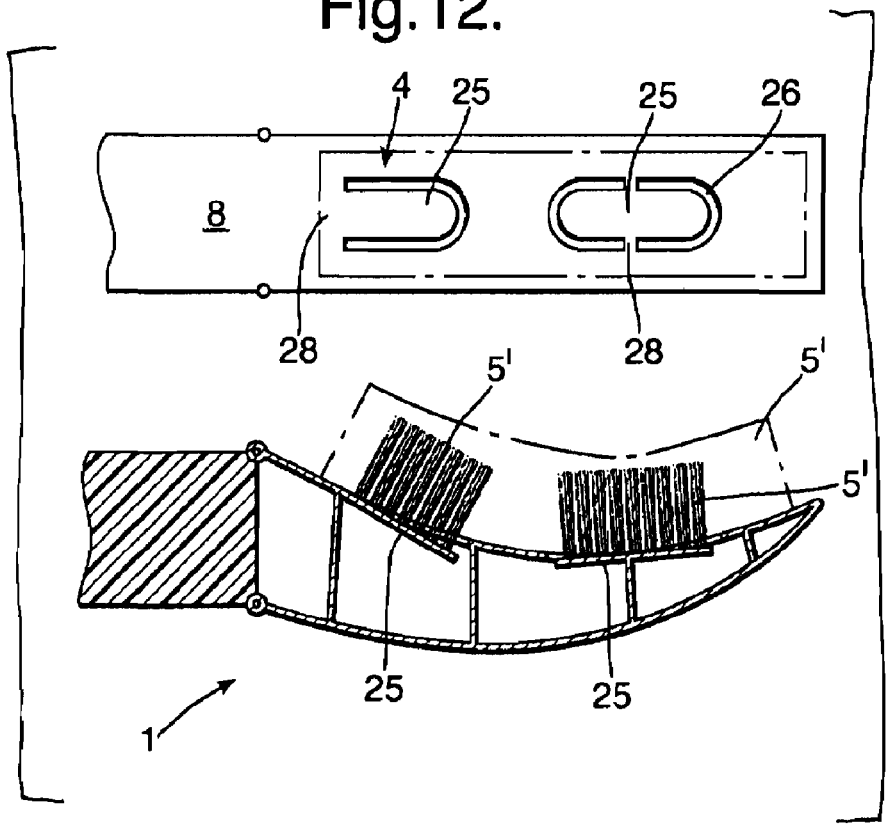

| | |
|---|---|
| FIG. 1 | a first example of an embodiment of the toothbrush according to the invention in a perspective, diagrammatic view; |
| FIG. 1a | a cross-section along the line A-A of FIG. 1; |
| FIG. 2 | a diagrammatic side view of the deformable element of the toothbrush according to the invention from FIG. 1; |
| FIG. 2a | an enlarged detail A from FIG. 2; |
| FIG. 3 | a diagrammatic side view of the deformable element from FIG. 2 in a cleaning position; |
| FIG. 4 | a further example of an embodiment of a toothbrush according to the invention; |
| FIG. 5 | a diagrammatic representation of the deformable element of a further example of an embodiment of a toothbrush according to the invention; |
| FIG. 6 | a diagrammatic representation of the deformable element of a further example of an embodiment of a toothbrush according to the invention; |
| FIG. 7 | a diagrammatic representation of the deformable element of a further example of an embodiment of a toothbrush according to the invention; |
| FIG. 7a | a cross-section along the line B-B from FIG. 7; |
| FIG. 8 | a diagrammatic representation of the deformable element of a further example of an embodiment of a toothbrush according to the invention; |
| FIG. 9 | a diagrammatic representation of the deformable element of a further example of an embodiment of a toothbrush according to the invention; |
| FIG. 10 | a further example of an embodiment of a toothbrush according to the invention; |
| FIG. 11 | a further example of an embodiment of a toothbrush according to the invention; |
| FIG. 12 | a further example of an embodiment of a toothbrush according to the invention in diagrammatic plan view and side view. |

First of all the general structure of a toothbrush according to the invention is described with reference to FIGS. 1 to 3.

FIG. 1 shows a first embodiment of a toothbrush according to the invention 1 in a diagrammatic 3-D view.

The toothbrush 1 has a handle area 2, a neck area 3 and a cleaning zone 4. The neck area 3 is located between the handle area 2 and the cleaning zone 4. On the cleaning zone 4 there are cleaning elements 5 which are only indicated diagrammatically in FIG. 1. Bristles, blades, fleece, elastomeric cleaning elements and all other suitable materials can be used as the cleaning elements 5. The toothbrush according to the invention 1 also has a deformable element 6 which in the example of an embodiment shown in FIG. 1 extends from the neck area 3 into the cleaning zone 4. The deformable element 6 is located inside the toothbrush in a wedge space 17.

The handle area 2 is provided for the user to hold the toothbrush 1 when brushing the teeth. The handle area 2 can be of any shape which allows a comfortable position of the toothbrush 1 in the user's hand, and meets the aesthetic requirements. The handle area can also be part of an electric toothbrush which replaces the cleaning movement by the user by a motorised movement. The user transmits the cleaning movement and the cleaning force through the handle area 2 of the toothbrush 1 in FIG. 1. The handle area of the embodiment presented in FIG. 1 has a thumb area 7 on which the user can rest his thumb when brushing his teeth and which is for example made of a particularly non-slip material.

The cleaning zone 4 of the toothbrush 1 is distanced from the handle area 2 by the neck area 3, for example to allow easy cleaning of the back premolars, where the handle area 2 and the user's hand remain outside the mouth.

The cleaning zone 4 of the toothbrush 1 carries the cleaning elements 5, which are pressed against the teeth during brushing by the cleaning force exerted by the user and clean them by means of a cleaning movement. The cleaning elements 5 can be secured to the cleaning zone 4 of the toothbrush 1 in any known manner. For example, the cleaning zone 4 can have holes (not shown) into which the cleaning elements 5, equipped with securing means, so-called anchors, are fitted. As in known toothbrushes, the cleaning elements 5 can be arranged at any angle to the cleaning zone 4 and at different angles to each other, and this aspect will be dealt with below. Alternatively, the cleaning zone 4 of the toothbrush 1 can also have a seating (not shown) in which a carrier element carrying the cleaning elements 5 is housed. Thus the carrier element with the cleaning elements 5 can be replaced and the rest of the toothbrush 1 can continue to be used. The carrier element is held in the seating for example by a snap-in device.

The deformable element 6 of the toothbrush according to the invention 1 is described more precisely below with reference to FIG. 2.

FIG. 2 shows a part of the toothbrush according to the invention 1 from FIG. 1 in a simplified diagrammatic side view.

The deformable element in FIG. 2 has a tension wing 8, a compression wing 9 and several guide elements 10.

The tension and compression wings 8, 9 provided flexibly diagonally to the longitudinal direction L each have a contact end 11 and a handle end 12. At the contact ends 11 the tension and compression wings 8, 9 in the embodiment represented in FIGS. 1 to 3 are connected firmly. At the handle ends 12 facing towards the handle area 2 the tension wing 8 and the compression wing 9 are at a distance from each other, so that the deformable element 6 is essentially in the shape of a wedge. The handle ends 12 are connected firmly to the handle 2 of the toothbrush according to the invention 1. The handle 2 is made of any essentially solid material, for example the typical plastics materials of which toothbrushes are made, so that the handle ends 12 are fixed to each other. The tension wing 8 and the compression wing 9 are each provided flexibly in a direction diagonal to the longitudinal direction L within the drawing plane of FIG. 2.

The wings 8, 9 form a wedge, which in longitudinal cut is defined by the ends 11, 12. Between the ends 11, 12 the wedge can be designed in any way, for example concave, convex or undulating. For example as seen in FIG. 1 the wings 8,9 curve concavely on the side closest to the cleaning elements 5.

Between the wings 8, 9 running together in a wedge shape several rib-shaped guide elements 10 running essentially linearly transverse to the longitudinal direction 'L' are arranged in the embodiment in FIGS. 1 to 3, and these guide elements connect the tension wing 8 to the compression wing 9.

The guide elements 10 in FIGS. 1 to 3 are made of a plastic material resistant to tension and compression. Alternatively tension mediums which are only resistant to tension, for example films, cords or chains, can be used as the guide elements 10.

In the embodiment illustrated in FIG. 2 the guide elements 10 are arranged at essentially equal longitudinal distances from each other. Alternatively the longitudinal distances between the individual guide elements 10 can vary and be provided differently within a deformable element 6. One end of each guide element 10 is connected with the tension wing 8 in a connection point 14, and the other end with the compression wing 9. In the embodiment illustrated in FIG. 2 the distances between the connection points 14 of the tension wing 8 are essentially the same as those of the compression wing 9. Alternatively these distances can differ.

The guide elements 10 of the embodiment in FIG. 1 are provided as plate-shaped rib elements between the tension and compression wings 8, 9. The guide elements 10 divide the wedge space 17 into several separate sections 17'. Depending on the cross-section of the wedge space 17 the guide elements 10 have a trapezoidal design, as illustrated in FIG. 1*a*.

FIG. 2*a* shows one of the connection points 14 as a detail A from FIG. 2. The guide element 10 in FIG. 2*a* is formed in one piece with the compression wing in the embodiment illustrated. The other connection points 14 in the embodiment in FIG. 2 are also formed in one piece with the tension or compression wings 8, 9.

The ends of the guide elements 10 are moveable and in the embodiment illustrated in FIG. 2 are in particular connected to the tension and compression wings 8, 9 in the manner of a joint or hinge. At the connection point 14 where the guide element 10 meets the wing 8,9 the guide element 10 is integrally thinned to provide a hinged connection point. The wings 8, 9 connected to each other by the guide elements 10 are thus arranged so that they can displace against each other in the longitudinal direction L. In the embodiment in FIGS. 1 to 3 the essentially straight guide elements 10 are arranged at right angles to the longitudinal axis M which runs equidistantly between tension and compression wings 8, 9.

The deformable element 6 is housed in the wedge space 17, which is inside the toothbrush and runs in the longitudinal direction L. The tension and compression wings 8, 9 of the deformable element 6 delineate the top and bottom of the wedge space 17. At the sides the wedge space 17 has a watertight seal in the form of an outer skin 18 illustrated in FIG. 1*a*, and is thus protected from dirt from outside. The guide elements 10 divide the wedge space 17 into separate, watertight sections 17'. Inside the wedge space 17 and in particular inside the sections 17' there is a gel or fluid which affects the elasticity of the deformable element 6 and thus the deformability of the toothbrush 1. Alternatively the guide elements can also be provided as struts which divide the wedge space in a non-watertight manner and which are surrounded by the fluid or gel. In the embodiment illustrated in FIG. 1 the outer skin 18 of the wedge space 17 is made of a transparent material, and so there is a viewing window to check the deformable element 6. As a result of the transparent outer skin 18 the user can check visually for any damage to the guide elements 10, for example. Also the aesthetics of the toothbrush 1 are improved by the deformable element 6 visible from outside.

In the embodiment illustrated in FIG. 1 the wedge space 17 extends as far as the thumb area 7 of the handle area 2. By pressing on the thumb area 7 made of a flexible material, the user can increase the pressure inside the wedge space 17 and thus influence the elasticity of the deformable element 6. The deformable element 6 is in a particularly hygienic form, out of the reach of dirt and bacteria, inside the toothbrush 1 and sealed off from the outside.

Alternatively, the wedge space 17 can also be provided without the outer skin 18, open at the sides.

In FIGS. 1 and 2 the toothbrush according to the invention 1 is represented in a resting or basic position in which no external forces are exerted on the toothbrush 1.

The advantageous deformation of the toothbrush according to the invention 1 during brushing of the teeth is described below with reference to FIG. 3. FIG. 3 shows the toothbrush 1 from FIG. 2 in a cleaning position during brushing of the teeth, when a cleaning force F is being exerted on the cleaning zone 4 of the toothbrush according 2 and pressed against the surface of one or more teeth 27. From the tooth the cleaning force F acts as a counterforce on the cleaning zone 4. For a comparison between the cleaning position and the resting position, the contour of the deformable element 6 from FIG. 2 is shown in FIG. 3 as a dotted line.

In the cleaning position illustrated in FIG. 3 the cleaning zone 4 is curved against the cleaning force F compared with the resting position. In the process the contact point 15 of the cleaning force F is deflected by a deformation route 16 in relation to its position 15' in the resting position. The tension and compression wings 8, 9 which are linear without the effect of the cleaning force bend under the cleaning force F against the direction of force F. The greater the cleaning force F, the more the tension and compression wings 8, 9 bend against this direction in which the cleaning force acts. As shown in FIG. 3, in a comparison of the resting and cleaning positions, the contact point 15 is displaced in the direction of force F in relation to the ends 11, 12 of the tension and compression wings 8, 9. The contact end 11 is moved in the longitudinal direction L by an offset 16' compared with the resting position. In the cleaning position the deformable element 6 has arched against the cleaning force in the shape of a fin. The guide elements 10 have twisted anticlockwise compared with the resting position and the connection points 14 of the tension and compression wings 8, 9 have been displaced in relation to each other in the longitudinal direction.

As a result of the deformation of the deformable element 6 represented in FIG. 3, the cleaning zone 4 of the toothbrush according to the invention 1 located on the tension wing 8 is also deformed essentially equally. This means that the cleaning elements 5 housed in the cleaning zone 4 are also deflected. As described above, the deformable element 6 bends around the contact point 15 of the cleaning force F in such a way that the cleaning zone 4 and the cleaning elements 5 are deformed around this area. In this way the cleaning elements 5 which in FIG. 3 are arranged at the sides in the longitudinal direction L are deflected around the teeth 27 from which the cleaning force F derives, and thus are pushed into the interdental spaces during brushing.

As the guide elements 10 are twisted in the cleaning position in relation to the resting position, in the embodiment in FIG. 3 the distance between the tension wing 8 and the compression wing 9 and thus the thickness of the toothbrush 1 is reduced. This is particularly advantageous because in this way it is easier to reach the difficult-to-reach premolars. Alternatively, the guide elements 10 can be arranged in the resting position at an angle of <90° to the axis M. This design of the resting position means that the twisting of the guide elements 10 in the cleaning position leads to an increase in the distance between the compression wing 9 and the tension wing 8. In the cleaning position the wings 8, 9 separate and the guide elements 10 do not, the deformable element is deformed as one unit.

FIG. 4 shows another embodiment of the toothbrush according to the invention 1, and in the description reference will only be made to the differences from the embodiment from FIGS. 1 to 3 described above. The toothbrush 1 in FIG. 4 has a smaller wedge space 17 and a smaller deformable element 6 than the embodiment in FIGS. 1 to 3. The same references as in the previous figures will be used for the same parts which are similar or identical in structure and/or function to parts in the previous embodiment. The deformable element 6 extends essentially only in the cleaning area 4 of the toothbrush 1, so that the neck 3 is a solid construction with handle 2. Otherwise the embodiment in FIG. 4 essentially corresponds to the embodiment in FIGS. 1 to 3. Naturally other embodiments are also possible where the deformable element 6 and the wedge shape 17 are even smaller than in FIG. 4 or larger than in FIG. 1, for example extending right into the handle area 2.

In the FIGS. 5 to 12 described below alternative embodiments of the toothbrush according to the invention 1 are represented which differ in different advantageous versions of the deformable element 6 and the wedge space 17. For the sake of simplicity, FIGS. 5 to 12 are diagrammatic and each show the part of the toothbrush according to the invention 1 which differs from FIGS. 1 to 3.

For the embodiments in FIGS. 5 to 12 only the differences from the embodiment in FIGS. 1 to 3 will be dealt with. The same references as in the previous figures will be used for the same parts which are similar or identical in structure and/or function to parts in the previous embodiment.

In the embodiment represented in FIG. 5 there are elastic spring elements 19 in the tension wing 8, the compression wing 9 and one of the guide elements 10. As a result of the spring elements 19 in the wings, the deflection of the contact end 11 is reduced because the relative travel of the tension and compression wings 8, 9 towards each other is limited. The spring element 19 in the guide element 10 limits the deformation of the deformable element above a certain cleaning force F, at least in the area of the guide element 10 with spring element 19. The cleaning force F above which the deformation is changed depends on the spring constants of the spring element 19.

The embodiment in FIG. 6 has a guide element 10 which loops the tension and compression wings 8, 9 together in a meandering form at several connection points 14 a-j arranged at a distance from each other. The deformable element 6 is pre-bent as the tension wing 8 is shorter than the compression wing 9. One end of the guide element 10 provided as the tension medium, e.g. a cable, is connected to the connection point 14*a* with the compression wing 9 in articulated form, e.g. by knobs. The guide element 10 is carried along the following connection points 14*b* to 14*i* in loops like a seam above the tension wing and beneath the compression wing. The second end of the guide element 10 with the tension wing 8 is connected to the connection point 14*j*. In this way the guide element 10 can be connected to several connection points 14 at the same time, which means that production time can be saved. Alternatively the deformable element 6 can be prestressed by the guide element 10 in FIG. 6, by shortening the length of the guide element 10 between the end connection points 14*a* and 14*j*. Shortening bends the deformable element 6 and deflects the contact end 11. When the guide element 10 in FIG. 6 is pulled in the direction of the arrow 20, for example, the contact end 11 is deflected in the direction of the arrow 21. The deformable element 6 in FIG. 6 is for example provided with just one looped guide element 10. Naturally several looped guide elements 10 or a combination of looped and non-looped guide elements 10 can be arranged in a deformable element 6.

FIG. 7 shows a further embodiment of the toothbrush according to the invention 1, where the deformable element 6 has a single, wedge-shaped guide element 110. As in the previous embodiments the tension wing 108 and the compression wing 109 are connected to each other in a movable way by the guide element 10. Unlike the previous embodiments, the ends 22 of the guide element 110 are in the form of a T-groove 23. The T-grooves 23 can be made of a different material from the rest of the guide element 110 and connected firmly to the rest, e.g. by adhesive. The tension wing 108 and the compression wing 109 each have T-shaped rail elements 24 which, as shown in FIG. 7*a*, engage in the T-groove 23 of the guide element 110 and together form a linear track. As a result of this linear track the tension wing 108 and the compression wing 109 are connected in such a way that they are moveable in relation to each other. The guide element 110 is made of a material which is resistant to tension or resistant to tension and compression, so that the slightest tensile stresses can be transmitted. Alternatively other forms of linear tracks can be used to connect the wings 8, 9.

FIG. 8 shows a further embodiment of a toothbrush according to the invention 1, in which the cross-section of the deformable element 6 is made up of a wedge-shaped section 6*b* and a rectangular section 6*b*, i.e. in which the wings 8,9 do not taper. In the rectangular section 6*a* the lengths of the guide elements 10 are essentially the same, and in the wedge-shaped section 6*b* the lengths of the guide elements 10 diminish in the direction towards the contact end 11.

By combining the rectangular section 6*a* with the wedge-shaped section 6*b* the curving of the deformable element 6 in the cleaning position is reduced compared with the embodiment represented in FIG. 2 with the same cleaning force F.

In the embodiment in FIG. 9 which is represented in solid lines for the cleaning position and in dotted lines for the resting position, the cross-section of the deformable element 6 is formed as a wedge which is wavy on both sides. The wavy form can be achieved by wavy wings 8, 9 or alternatively by one or more looped guide elements 10 which are prestressed, as described for the embodiment in FIG. 6. The wavy cross-section of the deformable element 6 means that the cleaning zone 4 and the cleaning elements 5 are also wavy. This can lead to a particularly responsive shape or to increased or reduced curving of the toothbrush 1 in the cleaning position. The wedge-shaped deformable element 6 can be convex, concave or in any suitable shape. Irrespective of the shape, the deformable element 6 bends against the cleaning force in the cleaning position. The cleaning zone 4 in the cleaning position is displaced essentially in parallel, retaining the axis of rotation of the cleaning movement.

FIG. 10 shows a further advantageous embodiment of the toothbrush according to the invention 1 in a perspective view. In this embodiment the toothbrush according to the invention 1 has two deformable elements 6*a*, 6*b* lying alongside each other. The individual deformable elements 6*a*, 6*b* are each provided according to one of the embodiments described above. On each of the deformable elements 6*a*, 6*b* there are separate cleaning zones 4*a*, 4*b* on which cleaning elements 5 are housed.

FIG. 11 shows a further embodiment of a toothbrush according to the invention 1 where the deformable element 6 has two tension wings 8*a*, 8*b* lying alongside each other in the longitudinal direction L and a compression wing 9. The two tension wings 8*a*, 8*b* and the compression wing 9 are connected tightly to each other at their contact end 11, as in the embodiments described above.

The compression wing 9 is connected to the tension wing 8*a* by linear connecting elements 10*a* and to the tension wing 8*b* by separate, also linear, connecting elements 10*b*. Alternatively, the two tension wings 8*a*, 8*b* can also be connected to the compression wing 9 by connecting elements which are V-shaped as seen along the longitudinal direction.

In the embodiment represented in FIG. 11 there are cleaning zones 4*a* and 4*b* on the two tension wings 8*a*, 8*b*. For the sake of clarity, the cleaning elements are not shown in the representation in FIG. 11.

FIG. 12 shows a further embodiment of a toothbrush according to the invention 1 in a diagrammatic plan view and side view. As shown in the plan view in FIG. 12, the tension wing 8 has two cleaning tongues 25 in the cleaning zone 4. The cleaning tongues 25 are part of the cleaning zone 4 and are connected to the cleaning zone 4 on one side. On the other sides the cleaning tongues 25 are separated from the tension wing 8 by a partition 26, leaving a small bridge 28 of.

In the side view of the embodiment in FIG. 12, which is represented in the cleaning position, the cleaning tongues 25 are tangential to the curved tension wing 8, because there are only connected to the tension wing 8 on one side. The cleaning elements 5' located on the cleaning tongues 25 are arranged offset to the other cleaning elements 5 in the cleaning position. Thus in the cleaning position there is a structured arrangement of the cleaning elements 5, 5'.

Naturally, further embodiments of the toothbrush according to the invention 1 in addition to those represented in the figures are possible. For example, the toothbrush according to the invention 1 can be provided with an actuator, e.g. an electric motor, which initiates a movement in at least one wing 8, 9, in order to replace or support the cleaning movement by the user.

The invention claimed is:

1. A toothbrush with at least one cleaning zone on which tooth-cleaning elements are arranged, which are pressed against the teeth during cleaning with a cleaning force, and with at least one deformable element by which the cleaning zone can be adapted to the shape of the tooth surface by the cleaning force, where the deformable element has at least a first flexible wing arranged relatively towards the cleaning zone and a second such wing arranged relatively away from the cleaning zone, and also at least one guide element, and where the first and second wings are held together moveably by the guide element, characterized in that the wings form a wedge, being connected together at one end and distanced from each other at the other end, and the wings hold a wedge space at least partially filled with an elastic material.

2. The toothbrush according to claim 1, characterized in that the wings are provided as a tension wing arranged relatively towards the cleaning zone and a compression wing arranged relatively away from the cleaning zone and the toothbrush can be moved from a resting position to a cleaning position by the cleaning force exerted on the cleaning zone, whereby in the cleaning position the cleaning zone curves towards the cleaning force compared with the resting position.

3. The toothbrush according to claim 1, characterized in that the wings form a wedge in which they are joined together at a point further from the handle, and are at a distance from each other at a point closer to the handle.

4. The toothbrush according to claim 1, characterized in that the deformable element is housed inside the toothbrush.

5. The toothbrush according to claim 1, characterized in that the wedge space contains a gel or fluid.

6. The toothbrush according to claim 5, characterized in that the wedge space is at least partially transparent and the deformable element can be seen from the outside.

7. The toothbrush according to claim 1, characterized in that the deformable element extends at least partially into the cleaning zone.

8. The toothbrush according to claim 1, characterized in that in at least one of the wings there is at least one spring element which is elastic in the longitudinal direction which absorbs tension or compression forces.

9. The toothbrush according to claim 1, characterized in that in the guide element there is at least one elastic spring element.

10. The toothbrush according to claim 1, characterized in that the guide element is essentially resistant to tension.

11. The toothbrush according to claim 1, characterized in that the guide element is essentially resistant to compression.

12. The toothbrush according to claim 1, characterized in that the guide element is formed as one piece with the tension and/or compression wing.

13. The toothbrush according to claim 1, characterized in that the guide element is connected to the wings in an articulated form manner.

14. The toothbrush according to claim 1, characterized in that the guide element is rib-shaped and divides the wedge space into at least two sections separated from each other and which can be filled with gel or liquid.

15. The toothbrush according to claim 1, characterized in that the guide element is essentially linear and the tension and compression wing at maximum distance is arranged essentially at right angle to an axis, which runs equidistantly between the tension wing and the compression wing.

16. The toothbrush according to claim 1, characterized in that the guide element loops the wings together alternately at several connection points at a distance from each other.

17. The toothbrush according to claim 1, characterized in that the toothbrush has several deformable elements which mould independently to the profile of the teeth.

18. The toothbrush according to claim 1, characterized in that the deformable element has two tension wings and one compression wing, whereby the guide element connects the compression wing to the two tension wings.

19. The toothbrush according to claim 1, characterized in that the deformable element has two tension wings and one compression wing and at least two guide elements which each connect the compression wing to one of the two tension wings.

20. The toothbrush according to claim 1, characterized in that there are cleaning tongues in the cleaning zone which protrude tangentially when the cleaning zone is curved.

* * * * *